US005485783A

United States Patent [19]

Rau et al.

[11] Patent Number: 5,485,783

[45] Date of Patent: Jan. 23, 1996

[54] APPARATUS FOR FASTENING A FLEXIBLE PRINTING PLATE

[75] Inventors: Gunnar Rau, Königsbrunn; Karl-Heinz Müller, Gersthofen; Heinrich Schmid, Kutzenhausen, all of Germany

[73] Assignee: MAN Roland Druckmaschinen AG, Offenbach, Germany

[21] Appl. No.: 257,343

[22] Filed: Jun. 9, 1994

[30] Foreign Application Priority Data

Jun. 9, 1993 [DE] Germany ..... 43 19 167.3

[51] Int. Cl.[6] ..... B41F 27/06

[52] U.S. Cl. ..... 101/378; 101/415.1

[58] Field of Search ..... 101/378, 415.1, 101/382.1, 383, 375

[56] References Cited

U.S. PATENT DOCUMENTS

| | | | |
|---|---|---|---|
| 3,608,487 | 9/1971 | Luehrs | 101/415.1 |
| 5,010,818 | 4/1991 | Wallchaeger | 101/415.1 |
| 5,272,977 | 12/1993 | Horiguchi et al. | 101/378 |

FOREIGN PATENT DOCUMENTS

| | | | |
|---|---|---|---|
| 1173916 | 7/1962 | Germany . | |
| 1263022 | 3/1968 | Germany . | |
| 2545618 | 4/1977 | Germany . | |
| 3116506 | 11/1982 | Germany . | |
| 262191 | 11/1988 | Germany . | |
| 4035616 | 6/1991 | Germany . | |
| 4226565 | 2/1993 | Germany . | |
| 1556389 | 11/1979 | United Kingdom | 101/415.1 |

*Primary Examiner*—Edgar S. Burr
*Assistant Examiner*—Anthony H. Nguyen
*Attorney, Agent, or Firm*—Cohen, Pontani, Lieberman, Pavane

[57] ABSTRACT

A plate-clamping apparatus suitable for automatic exchanges of plates and has only a narrow clamping channel. The apparatus includes a tie beam, which has clamping bodies that are elastic in the clamping direction and on the ends of which radial forces can be applied by actuating devices, that is elastically disposed in the cylinder groove.

10 Claims, 6 Drawing Sheets

APPARATUS FOR FASTENING A FLEXIBLE PRINTING PLATE

BACKGROUND OF THE INVENTION

1. Field of the Invention

The invention relates to an apparatus for fastening a flexible printing plate, on the printing cylinder of a printing machine.

2. Description of the Prior Art

DE 31 16 506 C2 discloses an apparatus for fastening a flexible printing plate, which has a clamping groove with two groove walls running out at an acute angle to the cylinder-jacket surface. Two clamping bodies provide the clamping and are divided in the longitudinal direction of the groove and clamp the plate leg between themselves and a groove wall. Admittedly, this mechanism of clamping the plates permits an automatic exchange of plates, however, because of the space needed for the clamping bodies, it requires a wide clamping channel which is equivalent to a loss in printing area.

SUMMARY OF THE INVENTION

It is an object of the invention to provide a plate clamping mechanism, which is suitable for exchanging plates automatically and which has a single narrow clamping channel.

Pursuant to this object, and others which will become apparent hereafter, one aspect of the present invention resides in an apparatus for fastening a flexible printing plate on a printing cylinder of a printing machine, which apparatus includes a tie beam disposed in an axially extending groove in the printing cylinder. Springs elastically support the tie beam against the bottom of the cylinder groove. A clamping body is carried by the tie beam and has clamping surfaces which cooperate with the wails of the groove to hold the ends of the flexible printing plate therebetween.

In another embodiment of the invention the clamping body is fixed to the tie beam. It is also possible to accommodate the clamping body in the tie beam so that it is movable in a clamping direction and is supported elastically on the tie beam so that it can be extended to a stop point. The tie beam extends approximately to the end of the cylinder shell and can be acted upon by actuating devices with forces directed radially on the printing cylinder.

In still another embodiment of the invention, the clamping body is arranged in a groove in the tie beam and is braced elastically against the base of the tie beam groove. Sleeves are bolted to the bottom of the clamping body with the interpositioning of a stop ring, and the sleeves are inserted through a bore holes in the tie beam so as to cover the stop ring.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
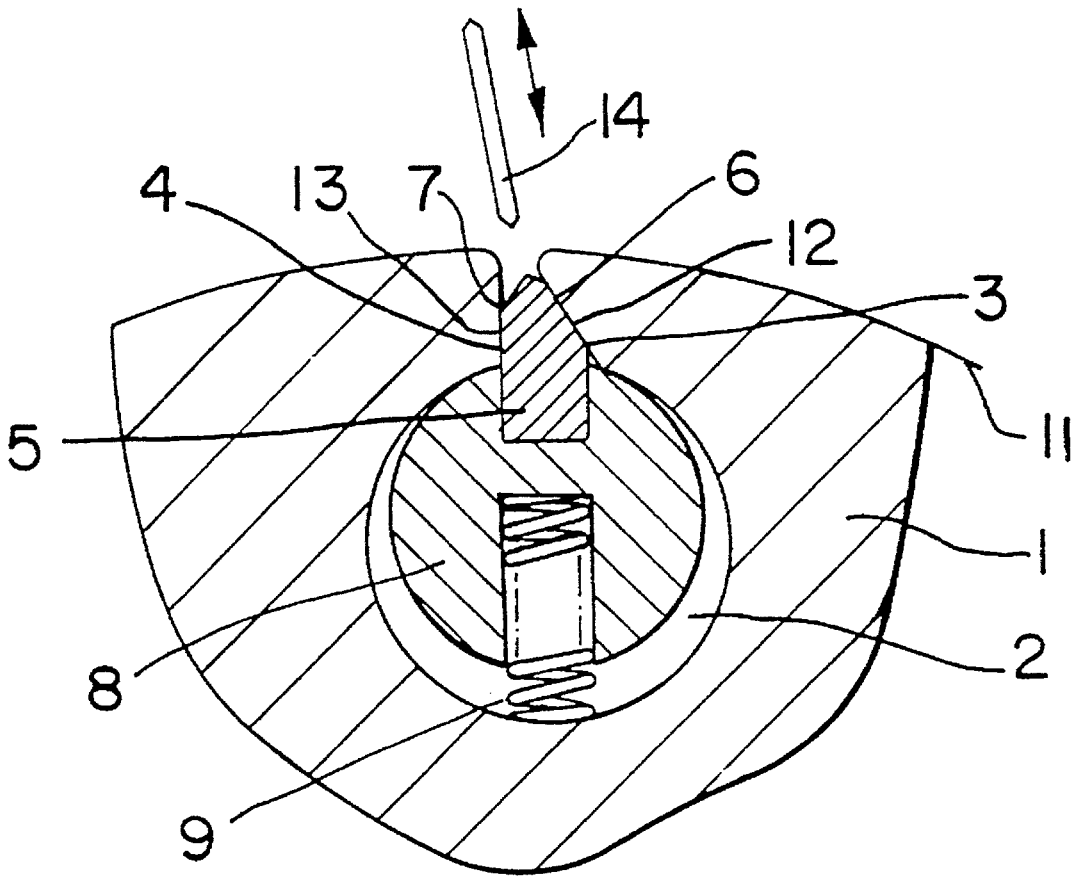
FIG. 1 is an inventive plate-clamping mechanism in cross section.

The printing cylinder 1, shown sectionally in FIG. 1, has a cylindrical groove 2 which extends in the axial direction and contains acute-angled groove walls 3, 4, which extends approximately perpendicularly to the shell of the cylinder 1. A clamping body 5 cooperates with the groove walls 3, 4 and advantageously has clamping surfaces 6, 7, which are parallel to the groove walls 3, 4. The clamping body 5 is disposed fixed on a tie beam 8, which is braced by means of compression springs 9 against the bottom of the cylinder groove 2. The clamping body 5 may, for example, be bolted to the tie beam 8 or pressed into a groove. The tie beam 8, together with the clamping body 5, extends at least over the width of the printing plate 11 on the outer surface of the printing cylinder 1.

The printing plate 11 is suspended with a leading plate leg 12 at a channel edge formed by the cylinder surface and the groove wall 3. In so doing, the plate leg 12 is clamped between the groove wall 3 and the clamping surface 6. During a revolution of the printing cylinder 1, which takes place subsequent to clamping of the leg 12, the printing plate 11 is rolled onto the printing cylinder 1 advantageously by using a counterpressure roller or the positioned rubber cylinder. Finally, a trailing leg 13 of the printing plate 11 is pressed between the groove wall 4 and the clamping surface 7 of the clamping body 5. The insertion of the plate legs 12, 13 is facilitated by providing the clamping body 5 with inclined slopes. To remove the printing plate 11, the clamping body 5 is pressed, together with the tie beam 8, against the force of the spring 9 deeper into the cylinder groove 2 by a plate-detaching tool 14. In so doing, the wedging action of the clamping body 5 against the groove walls 3, 4 is cancelled and the trailing leg 13 of the plate 11 springs out of the groove 2. After the printing plate 11 is uncoiled from the cylinder surface, the leading leg 12 of the plate 11 can also be removed by once again pressing on the clamping body 5.

Figure 2:
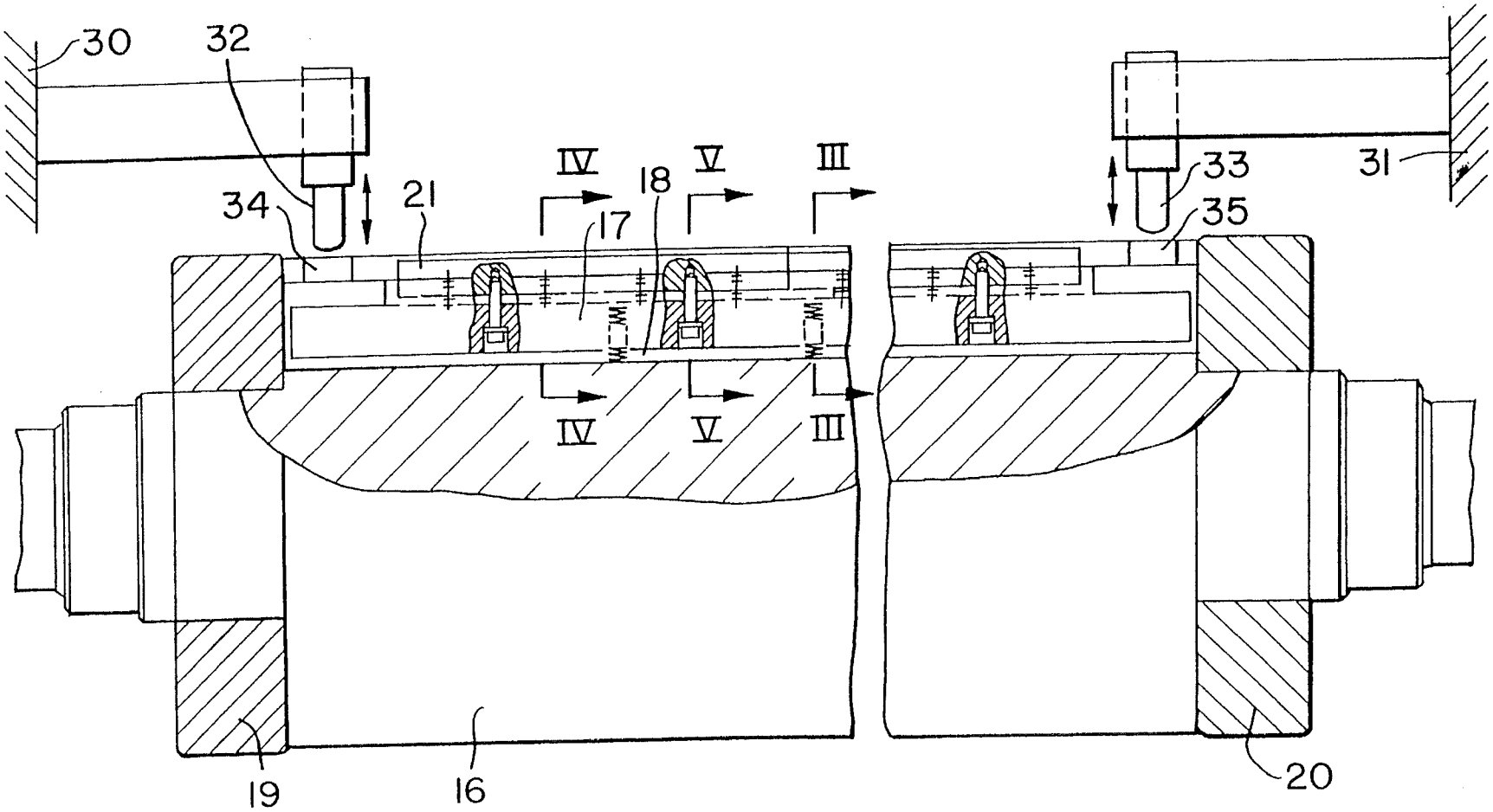
FIG. 2 is a side view of a printing cylinder with a further embodiment of the plate-clamping mechanism.
Figure 3:
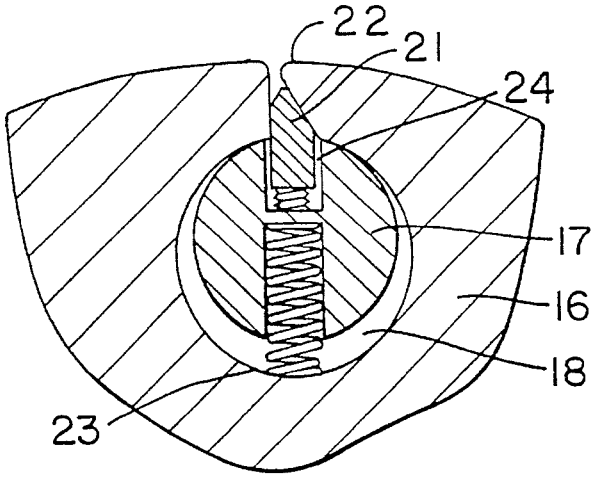
FIG. 3 is a section II—III of FIG. 2.
Figure 4:
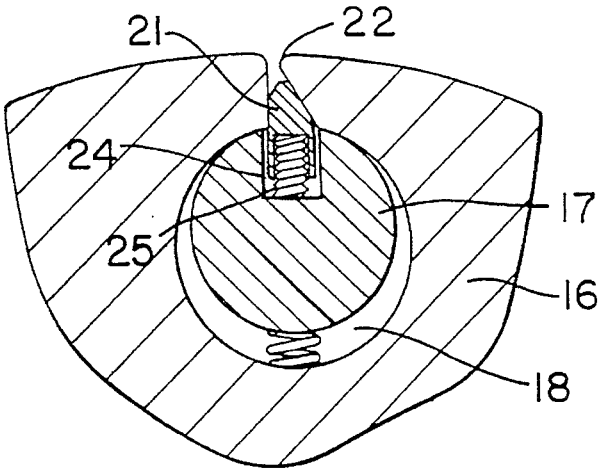
FIG. 4 is a section IV—IV of FIG. 2.
Figure 5:
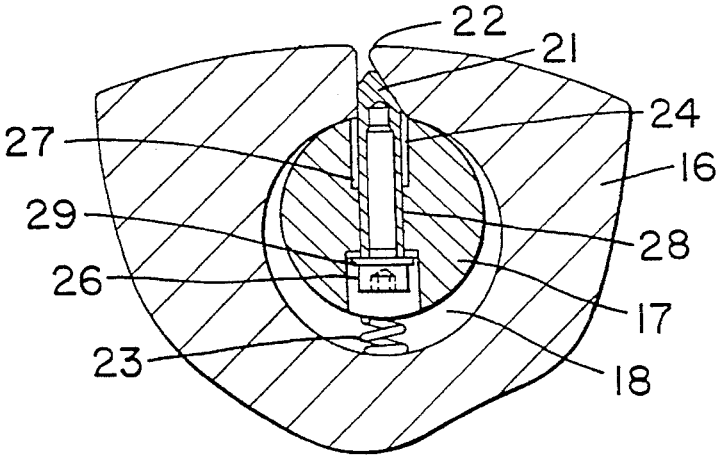
FIG. 5 is a section V—V of FIG. 2.

FIG. 2 shows a printing cylinder 16, for which a tie beam 17 extends into the cylinder groove 18 up to the ends of the cylinder shell and bearer rings 19, 20. Moreover, the clamping body is composed of clamping pieces 21, which are joined together and accommodated elastically in the tie beam 17. The division into clamping pieces is advantageous from a manufacturing point of view. In addition, good clamping of the printing plate 22 at the groove walls is achieved. Moreover, the cylinder groove 18 is geometrically identical with the cylinder groove 2 of FIG. 1. Only the width of the channel can, under certain circumstances, be kept narrower in the case of cylinder groove 18 since, for reasons given further below, the plate-detaching tool 14, which is required in FIG. 1, can be omitted. The tie beam 17 is braced by means of compression springs 23 in the base of the cylinder groove 18 (FIG. 3). Each clamping piece 21 is accommodated in a groove 24 of the tie beam 17 (FIG. 4) and is braced with springs 25 against the bottom of the groove 24. Each clamping piece 21 has clamping surfaces, which are not labeled and are similar to those of the clamping body of FIG. 1. Two sleeves 27, with which the clamping pieces 21 are movably guided in the clamping direction in boreholes 28 of the tie beam 17, are bolted with screws 26 to the underside of each clamping piece 21 (FIG. 5). A stop ring 29, which covers the borehole 28, is interposed between the sleeve 27 and the head of the screw 26. The clamping pieces 21 can also be guided differently, for example, by means of pins or the sidewalls of the groove 24. At each sidewall 30, 31 of the machine, a push rod 32, 33 is disposed, which can be moved through a borehole 34, 35 of the cylinder shell of the printing cylinder 16 in the radial direction and onto the tie beam 17.

The printing plate 22 is clamped in the same way as described in the previous embodiment of FIG. 1. The plate legs are clamped by the clamping pieces 21, which are pressed by the spring-loaded tie beam into the wedge formed by the groove walls. So that they lie securely against the plate legs, the clamping pieces 21 are cushioned somewhat in the tie beam 17, a gap being formed between the stop ring 29 and the borehole 28. For the purpose of loosening the printing plate 22, the printing cylinder 16 is positioned so that the boreholes 34, 35 of the cylinder shell come to lie under the push rods 32, 33. When the push rods 32, 33 are extended, the tie beam 17 is pressed against the force of the compression springs 23 in the direction of the base of the clamping groove 18. After the gap between the stop ring 29 and the borehole 28 (FIG. 5) is overcome, the clamping pieces 21 are also carried along, that is, pulled out of the wedge formed by the groove walls and the plate legs are freed. Because plate-detaching means do not have to be introduced into it, the clamping channel can be kept very narrow, for example, 2 mm wide or less. Limits for the minimizing are set practically only by the thickness of the printing plate and the interests of the manufacturing process.

Figure 6:
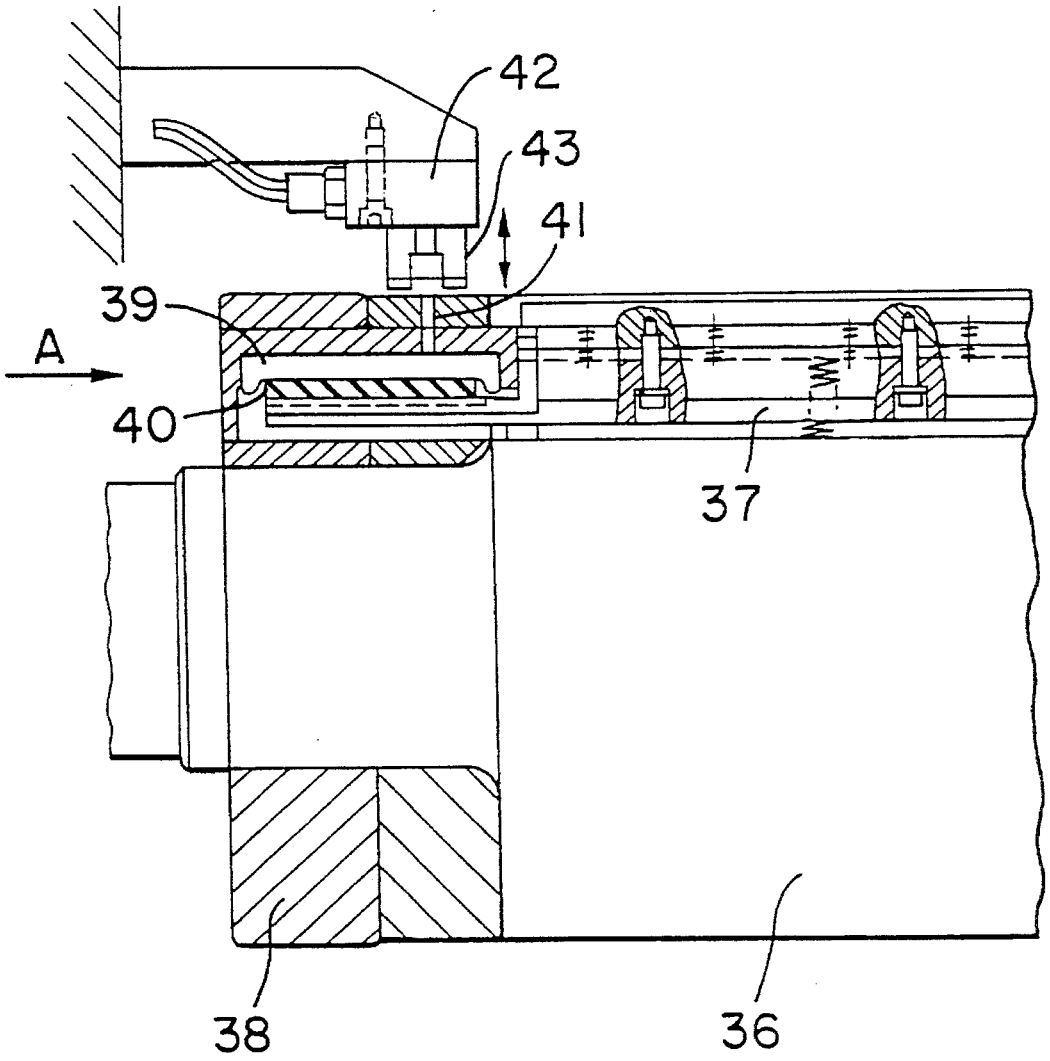
FIG. 6 is a further embodiment for actuating tie beams.
Figure 7:
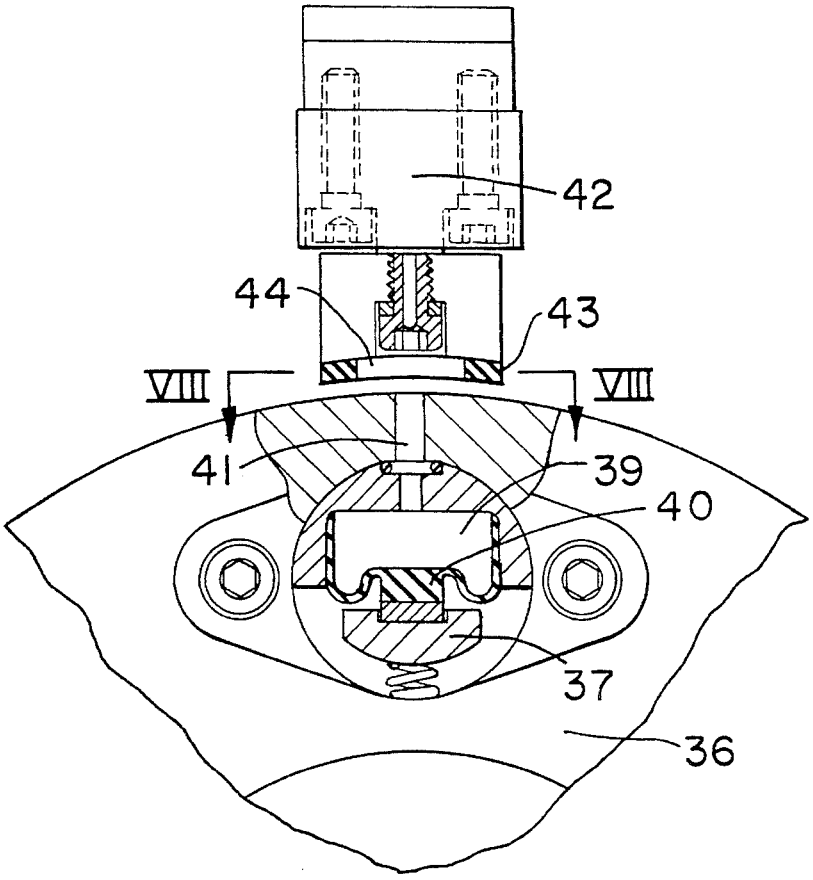
FIG. 7 is a view along the arrow A of FIG. 6.
Figure 8:
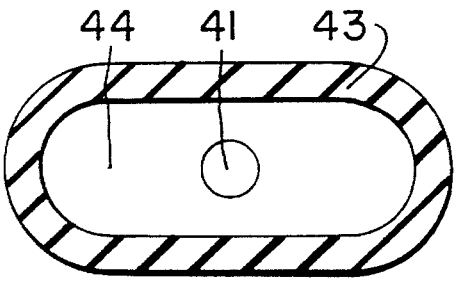
FIG. 8 is a section VIII—VIII of FIG. 7.
Figure 10:
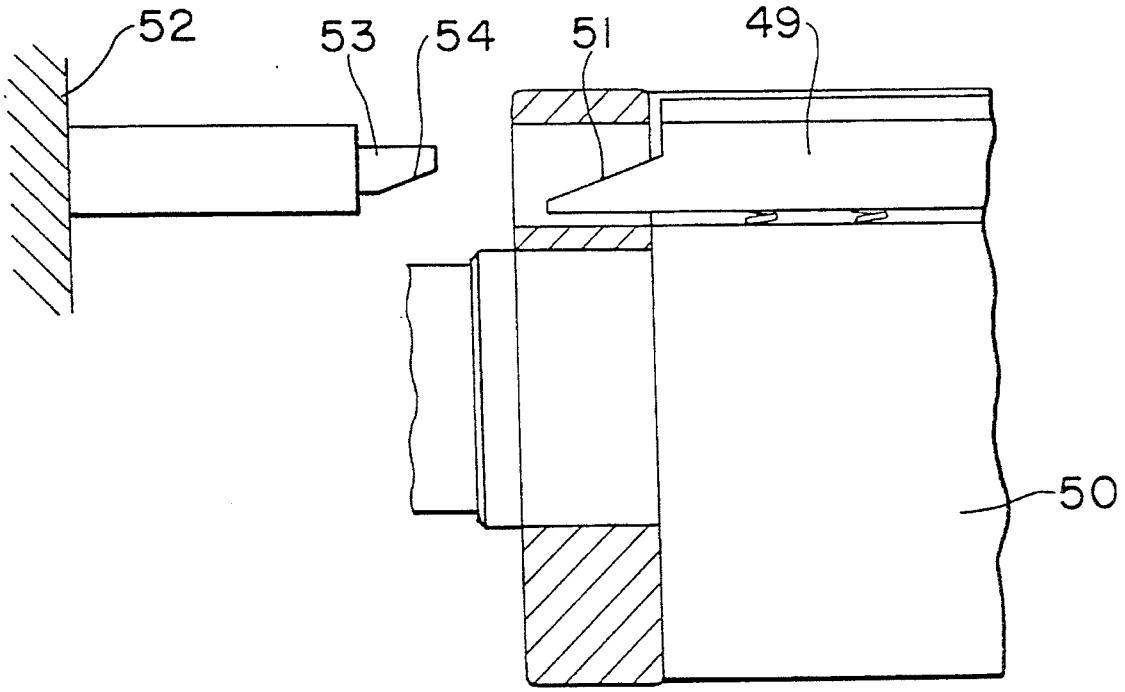
FIG. 10 is another embodiment for actuating tie beams.

FIGS. 6 and 10 show variations for actuating the tie beam, which are different from those of FIG. 2. In each case, only the actuating device at the left end of the printing cylinder shell is shown, a similar device being provided at the right end of the shell. In the case of the printing cylinder of FIG. 6, the tie beam 37 extends into the bearer ring 38 and ends in the region of a pressure chamber 39. The latter pressure chamber 39 has a membrane 40, which can be deflected radially onto the tie beam 37 and is connected with the outside atmosphere by a connecting borehole 41, which leads through the cylinder shell. A connection shoe 43 of a compressed air source can be placed on the borehole 41 by means of a lifting device 42. The connecting shoe 43 has the curvature of the cylinder shell (FIG. 7), and its connecting opening 44 advantageously has the shape of an elongated hole (FIG. 8). Due to this elongated shape of the hole 44, the connecting borehole 41 need not be positioned precisely below the connecting shoe 43 for loosening the printing plate.

Figure 9:
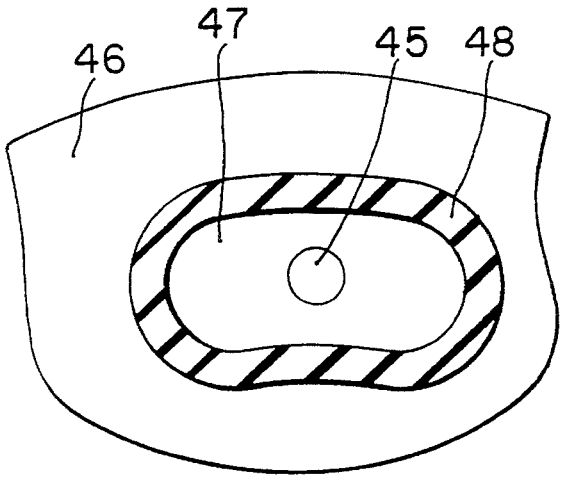
FIG. 9 is a section through a connecting shoe for connecting to the front face of a pressure chamber.

In accordance with FIG. 9, the connecting borehole 45 of a pressure chamber leads out of the front end of the printing cylinder 46. A connecting opening 47 of the connecting shoe 48 is constructed in the form of a circular segment here and the latter is surrounded by a fiat sealing surface.

For the purpose of loosening the printing plate, the printing cylinder 36 is positioned with its connecting borehole 41 under the connecting shoe 43. After the connecting shoe 43 has been lowered onto the shell surface of the printing cylinder 36, the pressure chamber 39 is filled with compressed air, whereupon the membrane 40 presses the tie beam 37 inward. At the same time, the plate legs are released as in the previous embodiment.

In accordance with FIG. 10, the tie beam 49 of the printing cylinder 50 has an inclined plane 51. A push rod 53, fastened to the side wall 52 of the machine, also has an inclined plane 54. When the push rod 53 is extended, the inclined planes 51, 54 slide upon one another and move the tie beam 49 radially inward and release the plate legs. The further loosening and also the clamping of the printing plates takes place as indicated for the first embodiment.

In the embodiments, the printing cylinder has only one cylinder groove for clamping a printing plate. Likewise, several grooves for clamping a corresponding number of printing plates can be disposed uniformly distributed over the circumference of the printing cylinder. Such arrangements also belong to the scope of the invention.

The invention is not limited by the embodiments described above which are presented as examples only but can be modified in various ways within the scope of protection defined by the appended patent claims.

We claim:

1. An apparatus for fastening a flexible print plate having a width on a printing cylinder of a printing machine, the printing cylinder having a shell with an axially extending groove having a groove wall that is at an angle to an outer surface of the cylinder shell and a groove wall approximately perpendicular to the outer surface of the cylinder shell, the apparatus comprising: a tie beam disposed in the cylinder groove; means for elastically supporting the tie beam against the bottom of the cylinder groove; a clamping body having clamping surfaces that conform to the groove walls, one of the clamping surfaces being approximately perpendicular to the outer surface of the cylinder shell, the clamping body being accommodated in the tie beam so as to be movable in a clamping direction and so that each of the clamping surfaces cooperates with a separate one of the groove walls to engage a separate end of the printing plate therebetween, the tie beam and the clamping body being adapted to extend at least over the width of the printing plate; means for elastically supporting the clamping body in the tie beam so that the clamping body can be extended to a stop, the tie beam being arranged to extend approximately to the end of the cylinder shell; and activating means for acting on the beam so that forces are directed radially on the printing cylinder.

2. An apparatus as defined in claim 1, wherein the means for elastically supporting the tie beam includes springs.

3. An apparatus as defined in claim 1, wherein the clamping body is fixed to the tie beam.

4. An apparatus as defined in claim 1, wherein the tie beam has a groove with a base, the clamping body being accommodated in the groove of the tie beam; and further comprising means for elastically bracing the clamping body against the base of the groove, and sleeves bolted to an underside of the clamping body with an interposed stop ring, the tie beam having a plurality of bore holes, each of the sleeves being inserted through one of the bore holes in the tie beam so as to cover the stop ring.

5. An apparatus as defined in claim 1, wherein the clamping body is formed of a plurality of clamping pieces which are joined together.

6. An apparatus as defined in claim 1, wherein the cylinder shell has a radially directed borehole near one of its ends, the actuating means including a push rod provided so as to be movable in a radial direction through the bore hole of the cylinder shell and so as to be engageable with the tie beam, the push rod being disposed in an end region of the tie beam at a sidewall of the printing machine.

7. An apparatus as defined in claim 1, wherein the tie beam has an end with an inclined surface, the actuating means including a push rod provided so as to be extendable in an axial direction of the printing cylinder, the push rod having an end with an inclined surface that cooperates with the inclined surface on the end of the tie beam, the push rod being disposed in an end region of the tie beam at one sidewall of the printing machine.

8. An apparatus as defined in claim 1, wherein the actuating means includes a pressure chamber disposed in an end region of the tie beam, the pressure chamber including a membrane arranged so as to be radially deflectable against the tie beam, the pressure chamber further having a connecting bore hole, and further comprising compressed air supply means including a connecting shoe which is placeable on the connecting bore hole of the pressure chamber.

9. An apparatus as defined in claim 8, wherein the connecting bore hole runs through the shell of the printing cylinder, the connecting shoe having a connecting opening formed as an elongated hole which is surrounded by a sealing surface having a curvature matching that of the cylinder shell.

10. An apparatus as defined in claim 8, wherein the printing cylinder has a front end, the connecting bore hole being arranged to run into the front end of the printing cylinder, the connecting shoe having a connecting opening formed as a circular segment that is surrounded by a flat sealing surface.

* * * * *